US006906469B2

(12) United States Patent
Langford et al.

(10) Patent No.: US 6,906,469 B2
(45) Date of Patent: Jun. 14, 2005

(54) RADIO FREQUENCY ION SOURCE WITH MANEUVERABLE ELECTRODE(S)

(75) Inventors: Marian Lesley Langford, Salisbury (GB); Stuart Neville Cairns, Salisbury (GB); Andrew John Marr, Salisbury (GB); Ian Blair Pleasants, Salisbury (GB)

(73) Assignee: The Secretary of State for Defence, Salisbury (GB)

( * ) Notice: Subject to any disclaimer, the term of this patent is extended or adjusted under 35 U.S.C. 154(b) by 0 days.

(21) Appl. No.: 10/432,313

(22) PCT Filed: Nov. 21, 2001

(86) PCT No.: PCT/GB01/05104

§ 371 (c)(1),
(2), (4) Date: Sep. 15, 2003

(87) PCT Pub. No.: WO02/43100

PCT Pub. Date: May 30, 2002

(65) Prior Publication Data

US 2004/0032211 A1 Feb. 19, 2004

(30) Foreign Application Priority Data

Nov. 24, 2000 (GB) ..... 0028682

(51) Int. Cl.[7] ..... H01J 7/24

(52) U.S. Cl. ..... 315/111.81; 315/111.71; 315/111.41; 250/426; 250/423 F; 250/423 R

(58) Field of Search ..... 315/111.81, 111.91, 315/111.41, 111.21; 250/423 R, 286, 281, 426, 423

(56) References Cited

U.S. PATENT DOCUMENTS

| | | | | |
|---|---|---|---|---|
| 4,092,543 A | | 5/1978 | Levy | 250/423 R |
| 4,521,719 A | | 6/1985 | Liebel | 315/111.81 |
| 4,630,566 A | | 12/1986 | Asmussen et al. | 118/50.1 |
| 5,444,258 A | | 8/1995 | Grigoryan et al. | 250/423 R |
| 5,684,300 A | | 11/1997 | Taylor et al. | 250/286 |
| 5,849,372 A | | 12/1998 | Annaratone et al. | 427/569 |
| 5,877,593 A | * | 3/1999 | Langford et al. | 315/111.31 |
| 6,407,382 B1 | * | 6/2002 | Spangler | 250/286 |

FOREIGN PATENT DOCUMENTS

| | | |
|---|---|---|
| GB | 420360 | 11/1934 |
| GB | 2296369 | 6/1996 |
| GB | 2311411 | 9/1997 |
| JP | 01244619 | 9/1989 |
| WO | WO 93/11554 | 6/1993 |
| WO | WO 96/19822 | 6/1996 |
| WO | WO 00/75953 | 12/2000 |

OTHER PUBLICATIONS

Japanese Patent Abstract No. 08306499, Nov. 22, 1996.
Japanese Patent Abstract No. 63206484, Aug. 25, 1988.

* cited by examiner

*Primary Examiner*—Tuyet Thi Vo
(74) *Attorney, Agent, or Firm*—Dean W. Russell; Kilpatrick Stockton

(57) ABSTRACT

An rf ion source suitable for low power operation over a range of pressures in air which comprises discharge electrode, a cathode and an anode, the cathode being connected to an rf signal supply through an associated coupling means and the anode adapted to provide a surface area over which a plasma discharge may occur no greater than substantially that of the cathodal area over which the discharge may occur. The anode and cathode are arranged to be maneuverable with respect to one another in order to reduce the power requirements of the system and provide a means of controlling the rf discharge and ionization. An extended rf ion source, comprising a series of electrode pairs, provides flexibility for use in a variety of circumstances.

12 Claims, 5 Drawing Sheets

RADIO FREQUENCY ION SOURCE WITH MANEUVERABLE ELECTRODE(S)

CROSS REFERENCE TO RELATED APPLICATIONS

This application claims priority to Great Britain Application No. 0028682.3 filed on Nov. 24, 2000 and is the U.S. national phase of International Application No. PCT/GB01/05104 filed on Nov. 21, 2001 published in English as International Publication No. WO 02/43100 A2 on May 30, 2002, the entire contents of which are hereby incorporated by reference.

This invention relates to a radio frequency (rf) ion source and in particular to a glow discharge source capable of low power operation over a range of pressures, including atmospheric, in air.

There has been considerable interest in the development of an ion source that is capable of operating under similar conditions to known commercially available electron impact (EI) ionisation sources but which is more robust.

EI sources are widely used in analysis systems where ionisation is required. However, EI sources have a number of disadvantages. In particular, they cannot operate in oxygen rich environments (and so cannot be used with air) and they lack versatility since they are restricted to producing positively charged ions in a relatively energetic ionisation process.

An ion source capable of operating efficiently at atmospheric pressures and in oxygen rich environments would therefore have a significant use with commercially available mass spectrometers for direct air sampling.

An rf ion source which overcomes some of the above problems is described in our international application PCT/GB95/02918. This source constitutes a positive and negative producing ion source which is capable of generating a stable plasma over a wide range of rf operating frequencies, rf peak to peak amplitudes and source presses. The source comprises an anode and one or more cathodes and coupling means for connect the cathode(s) to an rf signal supply (Note: the earthed electrode is customarily called the anode and the driven electrode the cathode). The surface area of the electrodes over which discharge can occur is restricted to promote discharge stability. Also the cathode(s) are shaped in order to substantially distort the electric field between the anode and cathode(s) so as to encourage maximal formation of ions and electrons.

The rf source described above is capable of operating at low power ranging from 0.1 W at 1 Torr to 1 W at atmospheric pressure. The ability to vary rf power (peak to peak amplitude) and rf frequency results in a flexible ionisation source whose strength can be varied and which can accommodate a variety of pressure regimes.

The invention of PCT/GB95/02918 envisages that the separation of the anode and the cathode(s) can be set at values in the range of 0.5 mm to 5 mm so as to allow optimisation of the plasma discharge.

To produce a plasma discharge at large anode/cathode separations requires that the overall power requirements of the system are sufficient to initiate the discharge at that distance. This requires more power than is required to main the discharge. In the development of portable (e.g. battery driven) equipment and other applications, where it is advantageous to keep power requirements as low as possible, it is preferable to reduce the power needed to initiate the discharge to that required to sustain it. This can be achieved by reducing the electrode spacing during discharge initiation and then increasing the electrode separation whilst maintaining a constant power requirement. However, the above rf source requires that the power be switched off and the apparatus be opened up before the separation of the anode and cathode(s) can be altered. This is inappropriate during field use and has health and safety implications.

It is therefore an object of the present invention to provide a positive and negative ion source which produces a stable plasma and which offers a greater degree of control over the separation of the electrodes in order to overcome the above mentioned problems.

According to the present invention there is provided an rf ion source comprising a pair of discharge electrodes having a cathode and an anode, the anode being adapted to provide a surface area over which a plasma discharge may occur that is not substantially greater than the cathodal area over which discharge may occur, and coupling means operably connected to the cathode for coupling the cathode to an rf signal supply wherein the source further comprises means for manoeuvring one or both electrodes to adjust the separation of the electrodes such that the plasma discharge can be controlled during operation.

Initial striking of the discharge is aided by reducing the electrode separation and this is facilitated by the manoeuvrable electrodes. Once the discharge has been formed the electrode separation can be increased until the desired separation has been reached. A source without this capability to manoeuvre the electrodes in use would require that the power supply be initially boosted in order to produce discharges at larger separations. It has been found that separations of between 0 and 5 mm can comfortably be achieved by the source.

Another advantage of the manoeuvrable electrode rf ion source is that it allows optimisation of the plasma discharge to be made without the need to cease operation and open the apparatus. Furthermore, any changes in the electrode separation that may have unexpectedly occurred, e.g. during transport of the apparatus or by instrument vibration, electrode corrosion, humidity changes etc., can easily be corrected.

When the discharge power, some pressure, discharge gas or rf frequency are changed the electrode separation over which a stable discharge is formed will also change. The manoeuvrable electrode source will allow changes in the discharge character to be compensated for by control of the electrode separation.

A further advantage of the invention stems from the reduction in power requirements provided by the manoeuvrable electrode arrangement. This makes it possible to power the source using miniaturised components, which in turn makes it feasible for the source to be coupled to handheld and other portable devices such as ion mobility spectrometers.

For design reasons usually only one of the two electrodes (anode/cathode) is manoeuvrable and the other is fixed in position. However, both electrodes may be made manoeuvrable if desired.

If the axis joining the two electrodes is taken to be the z axis then in order to provide the greatest level of control over the plasma discharge one (or both) electrode(s) is/are arranged to be manoeuvrable in both the lateral x-y plane as well as the z-direction.

Conveniently the manoeuvrable electrode system can be coupled to a feedback mechanism arranged to provide a fully automated, consistent and constant ion source. The rf forward power is a gauge of the discharge produced. Thus in order to achieve a constant source the feedback mechanism could monitor the rf forward power using an appropriate power meter and adjust the electrode separation accordingly.

The selection of the electrode material is important because the electrodes need to remain stable and provide a consistent discharge under the high, localised temperatures generated by the discharge. Accordingly the material chosen to form the electrodes should have a high melting point, have good thermal conductivity and minimal corrosion in air. An example of a suitable material would be Tantalum.

Conveniently power requirements can be reduced further by ensuring that the electrodes are sharpened to a needle point. This causes increased surface curvature and distortion of the electric field, which in turn increases the strength of the discharge enhancing ion formation.

The rf ion source of the invention will function over a range of pressures from atmospheric down to around 400 mTorr.

It has been found that because the power requirements of this system are relatively small (2 Watts being sufficient at atmospheric pressure and 0.1 W at 1 Torr) a series of electrode pairs (one cathode and one anode comprising each pair) can be used to form an extended ion source.

The electrode pairs could be arranged in a linear configuration or in a circular configuration. A circular configuration would be useful for situations where ionisation of a gas flowing through a large cross sectional area is required.

A linearly configured extended arrangement is useful in cases where the source is associated with fast gas flow systems, e.g. molecular/supersonic beams, where the chance of ionisation from a lone source may not be reliable but where a series of sources would ensure a good probability of ionisation. In such an arrangement each electrode pair may have its own rf signal supply and coupling means.

In both the linear and circular configurations the electrode pairs may be fixed or more conveniently may have manoeuvrable electrodes.

A further advantage of a linearly configured extended arrangement is that different electrode pairs could be configured to provide different discharge characteristics and consequently the system could rapidly switch from one regime to another. This would be of benefit when the system is connected to equipment such as ion mobility spectrometers. For example, it could provide the flexibility to produce optimum conditions for both positive and negative ion production or in a more specific case where a particular set of conditions are required (e.g. RF frequency, RF amplitude or even electrode material) selectively enhance the production (and hence detection) of a specific compound or class of compounds.

Variation of the RF frequency/amplitude is likely to require complicated electronics, and these are in turn liable to add expense and greater complexity. A fixed amplitude/frequency system, such as for the extended source, would require simpler electronics and would be cheaper and easier to use, maintain and construct.

Since the rf ion source of the invention has such a broad working pressure range and flexibility it can conveniently be coupled to a range of systems, such as ion mobility spectrometers, selected ion flow tubes or field ion spectrometers, mass spectrometers and analytical systems such as LC equipments.

PCT patent application WO 97/28444 (Graseby) describes the use of a DC corona discharge ion source which produces dopant ions. In general, the dopant ion species become the dominant reactant ions in the ionisation region and if an incoming sample is to be ionised it must undergo an ion-molecule reaction with the dopant ions. If the dopant ions produced only enable some types of sample vapours to undergo efficient ionisation then this increases the selectivity of the ionisation source.

The rf ion source of this application can also conveniently be used as a dopant source and provides additional advantages over the Graseby source in that the frequency, amplitude, DC offset, wave shape and bias can all be controlled as a means of either selectively or optimally producing particular dopant species.

Embodiments of the present invention will now be described, by way of example, with reference to the accompanying drawings, wherein FIG. 1 shows the manoeuvrable electrode ion source and feedback mechanism.

Figure 1:
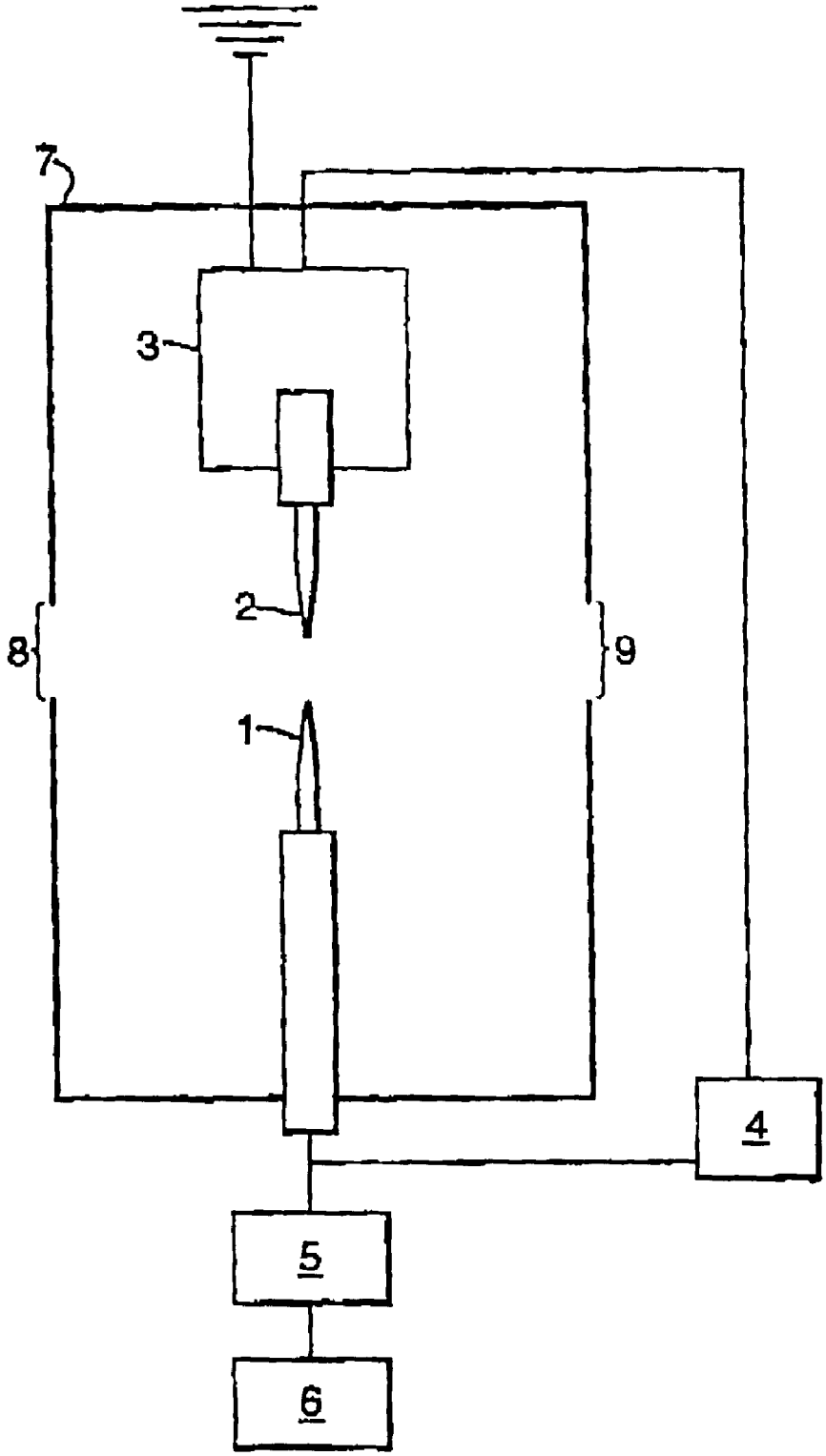

The rf ion source shown in FIG. 1 comprises a cathode 1 and a manoeuvrable anode 2. These discharge electrodes (1, 2) are fabricated from 1 mm diameter Tantalum wire (commercially available from Goodfellow Cambridge Ltd), but it will be appreciated that any suitable dimensioned electrical conductor may be substituted, with the tips of the electrodes (1, 2) being drawn into a needle point.

The anode 2 (which is earthed) is connected to means 3 for manoeuvring it in any direction relative to the cathode 1. A feedback mechanism 4, monitors the forward power via a suitable power meter and automatically adjusts the position of the anode 2 relative to the cathode 1 in order to provide a consistent plasma discharge. (Note: In an alternative arrangement cathode 1 can be moved relative to anode 2.)

Coupling means 5 is provided for the cathode 1 and is operably connected to a rf signal supply 6. The coupling means 5 is essentially similar to ones used in prior art ion sources except that the rf amplifier (not shown) is adapted to provide suitable amplification for the specific system ranging from 0.1 W at 1 Torr to 2 W at 1 atmosphere.

The rf ion source is located in an ionisation chamber 7 having an inlet 8 and an outlet 9.

Figure 2:
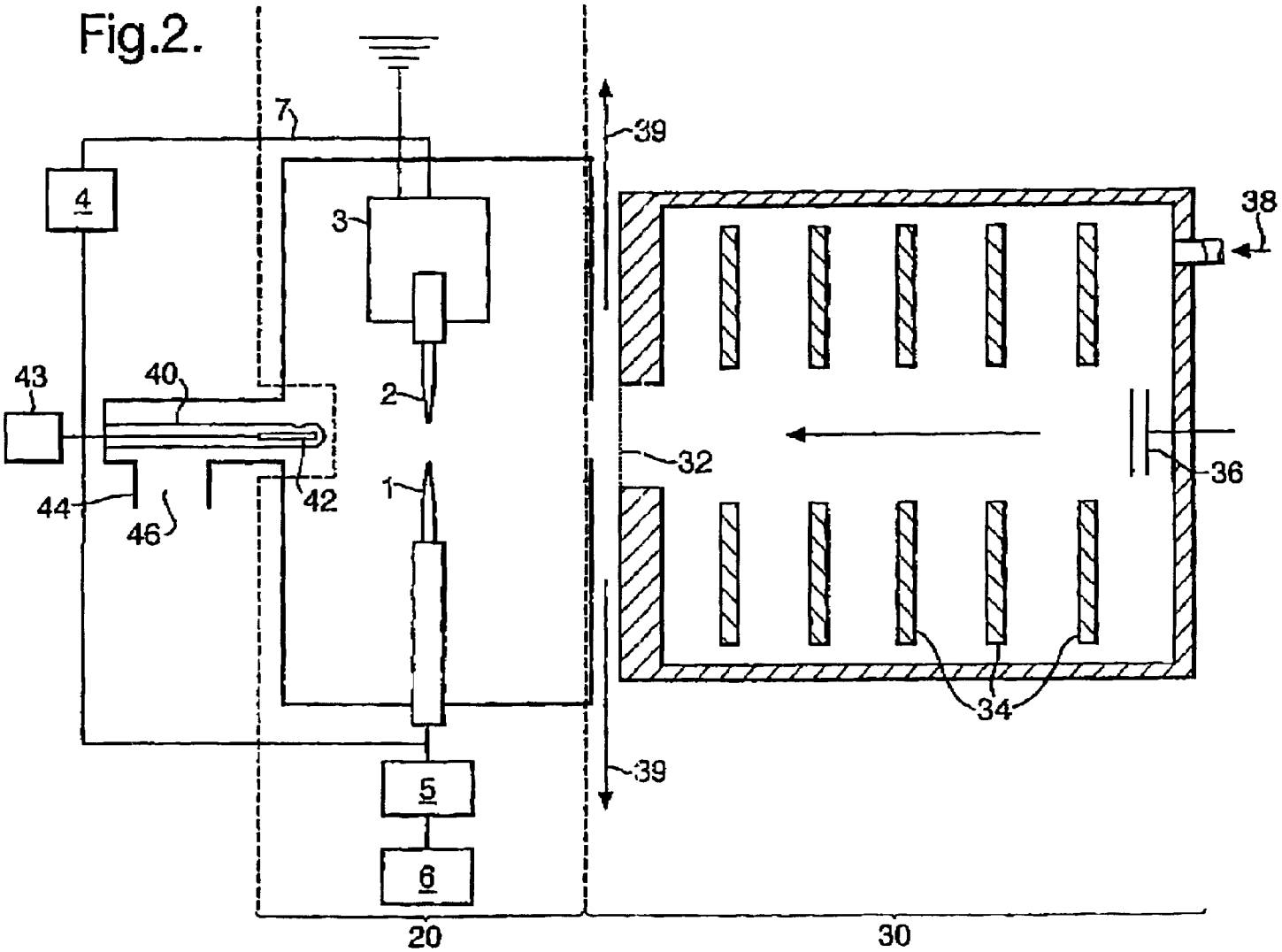
FIG. 2 shows the discharge source of FIG. 1 when connected to an ion mobility spectrometer.

An example of an application for which the ion source of FIG. 1 is suited is shown in FIG. 2. Here the rf ion source is operably connected to an Ion Mobility Spectrometer (IMS). Ion Mobility Spectrometry is a powerful technique for trace detection particularly for explosives and drugs detection (Note: Traditionally a radioactive source has been used as the ionisation source in an IMS). The IMS shown in FIG. 2 consists of three main regions; the RF ion source 20, drift cell 30 and gas flow system (38, 39, 46).

Samples to be tested are placed on a sample probe 40 which is introduced into the region of the rf source. A heating wire 42 which is connected to a power source 43 is provided to rapidly vaporise the sample. One arm of the gas flow system 44 passes air into the source chamber 7 in order to transport vaporised sample into the region of the ionisation source 20. (Note: The rf ion source shown in FIG. 2 is identical to the one shown in FIG. 1 and like numerals are used to depict identical features.)

The rf discharge source is positioned approximately 15 mm from gating grids 32 which separate the rf source 20 from the drift cell 30. In use, the gating grids 32 prevent ions from entering the drift cell 30 except when a voltage pulse is applied to open them for a short period (<1 ms) and allow a sample of ions formed in the source to pass into the drift cell.

The drift cell 30 comprises a series of ring electrodes 34 that produce an electric field gradient across the drift cell 30. In operation the field gradient will draw ions though the cell to a detector 36 (Faraday cup detector). Air is introduced into the drift cell at inlets 38 and 46 and exits via outlets 39. The counter a flow 38 provides an opposing force to the electric field that enhances ion mobility discrimination.

Figure 3:
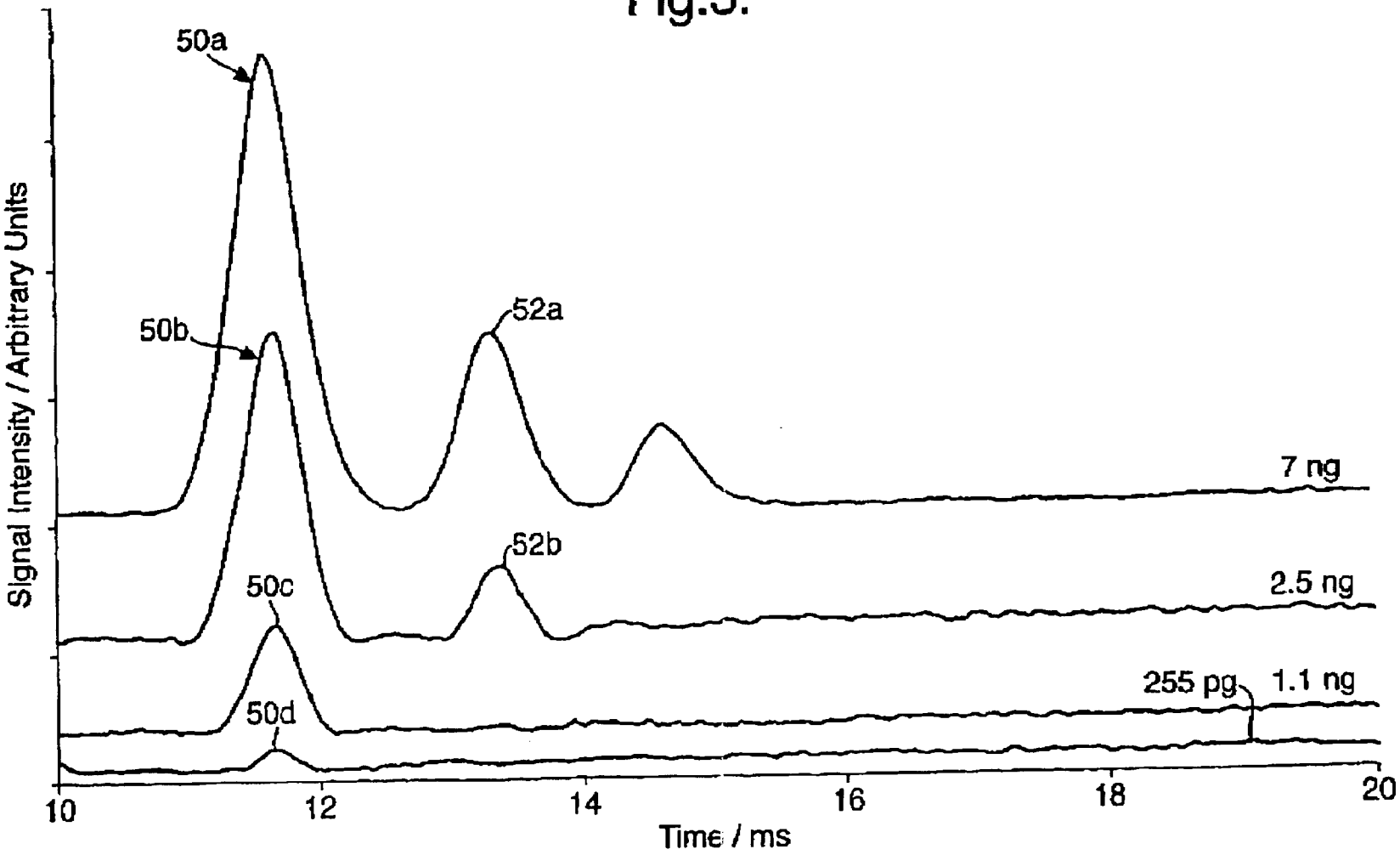
FIG. 3 shows ion mobility spectra of RDX and PETN using an rf ionisation source.

FIG. 3 shows a negative mobility IMS spectra produced for a series of RDX and PETN samples (corresponding to various amounts—indicated on graph) with an rf ion source. The peaks denoting RDX (50*a*, 50*b*, 50*c*, 50*d*) and PETN (52*a*, 52*b*) are clearly resolved.

Figure 4:
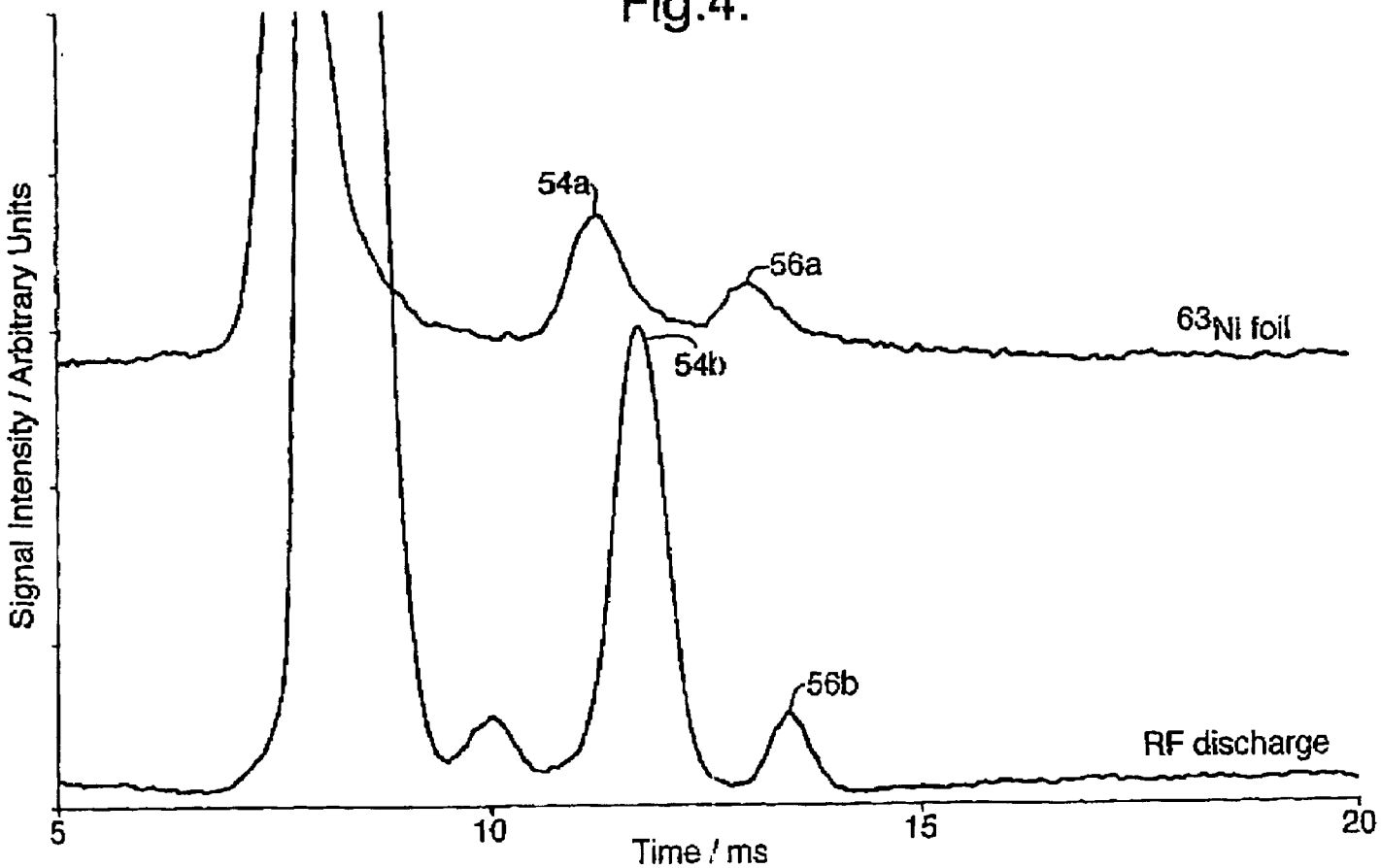
FIG. 4 shows a comparison of RDX and PETN sources obtained from rf sources and $^{63}$Ni radioactive sources.

FIG. 4 shows a comparison of rf ion source and $^{63}$Ni radioactive source results (results obtained with 1 ng samples). It is clear that the peaks recorded in the two spectra are produced in the same ionisation regime (Peaks 54*a* and 54*b* denote RDX and peaks 56*a* and 56*b* denote PETN) and that the rf ion source is a viable alternative to the radioactive source.

Figure 5:
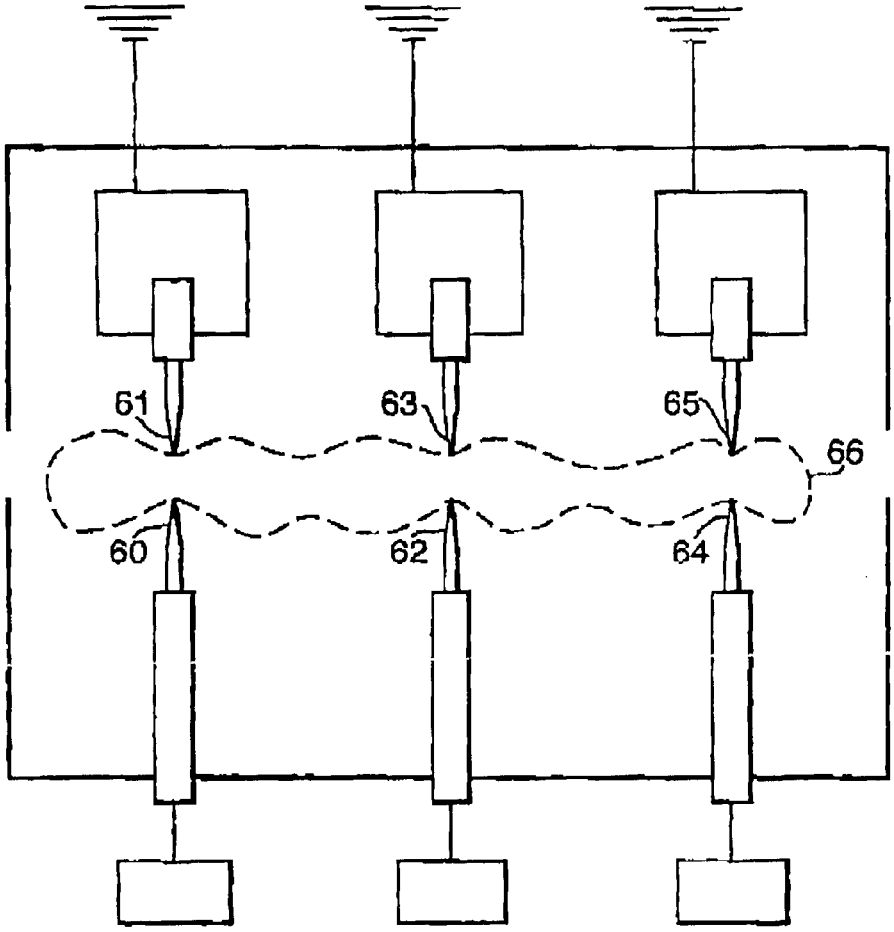
FIG. 5 shows an extended source arrangement.

FIG. 5 shows a series of three anode/cathode electrode pairs (60, 61; 62, 63; 64,65) which have been set up in series in order to produce an extended ionisation region (indicated by the hatched line 66). Such an extended ionisation region would be suitable for a fist flow or it sampling system or even for probing a supersonic gas flow. An example of its use might be with a fast gas sampling system such as atmospheric sampling prior to analysis with commercial mass spectrometer. The skilled man will appreciate that any number of electrode pairs could be connected together. In the case of the fast flowing system each pair of electrodes would be configured similarly and may only require one RF source amplifier and matching circuit. When put to a different use the multi-electrode pair system would have neighbouring electrode pairs set up for different ionisation regimes providing the versatility to rapidly switch from one regime to another. This could, for example, allow rapid switching from positive to negative ion formation mode. In practice this would require a different if source, rf amplifier and matching circuit for each pair of electrodes which themselves may be made from different materials and have different dimensions.

Figure 6:
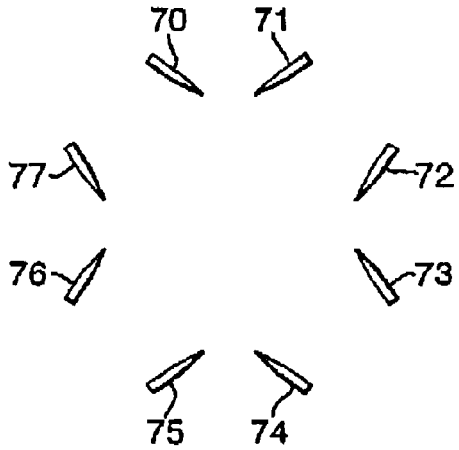
FIG. 6 shows a different configuration of the extended source arrangement.

FIG. 6 shows another arrangement of multi-anode/cathode electrode pairs (70, 71; 72, 73; 74, 75; 76, 77) where they are placed in a circular arrangement. This would provide a larger discharge region for particular situations where for example ionisation of a gas flowing through a large cross-sectional area was required or where the ionisation was necessarily relatively soft and hence only encompassed a small region.

What is claimed is:

1. An rf ion source comprising a pair of discharge electrodes having a cathode and an anode, the anode being adapted to provide a surface area over which a plasma discharge may occur that is not substantially greater than the cathodal area over which discharge may occur, and coupling means operably connected to the cathode for coupling the cathode to an rf signal supply wherein the source further comprises means for manoeuvring one or both of the electrodes to adjust the separation of the electrodes during plasma discharge operation such that the plasma discharge can be controlled.

2. An rf ion source as claimed in claim 1 wherein the means for manoeuvring one or both of the electrodes is capable of manoeuvring one or both of the electrodes in three perpendicular directions of motion.

3. An rf ion source as claimed in claim 1 wherein the electrodes can be moveable to define a gap therebetween from 0 to 5 mm.

4. An rf ion source as claimed in claim 1 wherein the means for manoeuvring one or both of the electrodes is operably coupled to a feedback mechanism in order to provide a consistent and constant ion source.

5. An rf ion source as claimed in claim 1 wherein the electrodes are formed into a needle point.

6. An extended rf ion source comprising a series of discharge electrode pairs according to claim 1 arranged in a circular configuration and coupling means operably connected to each cathode for coupling each cathode to an rf signal supply wherein the source further comprises means for manoeuvring some or all of the electrodes to adjust the separation of the electrodes such that the plasma discharge can be controlled during operation.

7. An rf ion source as claimed in claim 1 wherein the electrodes are fabricated from a material having a high melting point, good thermal conductivity and minimal corrosion in air.

8. An rf ion source as claimed in claim 7 wherein the material is Tantalum.

9. An extended rf ion source comprising a series of discharge electrode pairs according to claim 1 arranged in a linear configuration and coupling means operably connected to each cathode for coupling each cathode to an rf signal supply wherein the source further comprises means for manoeuvring some or all of the electrodes to adjust the separation of the electrodes such that the plasma discharge can be controlled during operation.

10. An extended rf ion source as claimed in claim 9 wherein each electrode pair has its own if signal supply and coupling means.

11. An extended rf ion source as claimed in claim 9 wherein different electrode pairs within the series of electrode pairs are arranged to provide different discharge characteristics.

12. An extended rf ion source as claimed in claim 9 wherein the rf frequency is fixed.

* * * * *